US008544943B2

(12) United States Patent
Fields

(10) Patent No.: US 8,544,943 B2
(45) Date of Patent: Oct. 1, 2013

(54) BARBER/BEAUTICIAN PERSONAL ASSISTANT

(76) Inventor: Rod Fields, Miami Gardens, FL (US)

( * ) Notice: Subject to any disclaimer, the term of this patent is extended or adjusted under 35 U.S.C. 154(b) by 268 days.

(21) Appl. No.: 13/100,330

(22) Filed: May 4, 2011

(65) Prior Publication Data

US 2012/0074739 A1 Mar. 29, 2012

Related U.S. Application Data

(60) Provisional application No. 61/386,984, filed on Sep. 27, 2010.

(51) Int. Cl.
*A47C 1/11* (2006.01)
*A47C 7/62* (2006.01)

(52) U.S. Cl.
USPC ..... 297/188.01; 297/188.21; 297/195.11; 297/461

(58) Field of Classification Search
USPC ..... 297/188.01, 188.08, 188.21, 195.11, 297/461
See application file for complete search history.

(56) References Cited

U.S. PATENT DOCUMENTS

| | | | | |
|---|---|---|---|---|
| 2,954,955 | A * | 10/1960 | Feller | 248/231.41 |
| 3,601,443 | A * | 8/1971 | Jones | 297/188.21 |
| 3,712,669 | A * | 1/1973 | Cates | 297/188.21 |
| 4,136,908 | A * | 1/1979 | Crayne | 297/188.21 |
| 4,372,605 | A * | 2/1983 | Cervantes | 297/188.11 |
| 4,607,882 | A * | 8/1986 | Opsvik | 297/195.11 |
| 4,645,167 | A | 2/1987 | Hardwick | |
| 7,219,956 | B2 * | 5/2007 | Zhang | 297/195.11 |
| 8,132,856 | B2 * | 3/2012 | Wilson et al. | 297/188.11 |
| 8,317,267 | B2 * | 11/2012 | Wallace | 297/423.12 |
| 2003/0218370 | A1 * | 11/2003 | Langham | 297/344.22 |
| 2007/0216205 | A1 | 9/2007 | Davis | |
| 2009/0039705 | A1 * | 2/2009 | Lyman et al. | 307/64 |
| 2009/0152915 | A1 * | 6/2009 | Krasna et al. | 297/217.3 |

* cited by examiner

*Primary Examiner* — Peter Brown
(74) *Attorney, Agent, or Firm* — Albert Bordas, P.A.

(57) ABSTRACT

A chair apparatus for facilitating performance of hairstyling services is disclosed. The chair apparatus includes a seat and a shaft coupled to a bottom face of the seat. The chair apparatus further includes a base coupled to a bottom end of the shaft and one or more castors coupled to a bottom face of the base. The chair apparatus further includes an arm coupled to the shaft, wherein the arm extends from the shaft to substantially the height of the seat. The chair apparatus further includes a tray coupled to a top end of the arm, wherein the tray comprises a flat surface and one or more hooks.

11 Claims, 2 Drawing Sheets

BARBER/BEAUTICIAN PERSONAL ASSISTANT

CROSS-REFERENCE TO RELATED APPLICATIONS

This patent application claims priority to provisional patent application No. 61/386,984 filed on Sep. 27, 2010. The subject matter of provisional patent application No. 61/386,984 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of hairstyling, and more particularly relates to the field of devices used as an aid to hairstylists.

BACKGROUND OF THE INVENTION

Hair styling is a major world industry that includes, among other things, salons, schools, beauty products, beautician instruments, and manufacturers of beauty products and instruments. As such, there are millions of workers in the hairstyling industry worldwide. Typically, barbers, beauticians and hairstylists, who comprise the largest set of hairstyling industry workers, perform their services while standing up. This allows the worker to move around the client as the worker cuts or styles the client's hair. Remaining standing up also gives the worker the freedom of movement to pick up and put down instruments, such as scissors and blow dryers, and wield his instruments for use on his client. This position further allows the worker to interact with his client at eye level, which facilitates the client-hairstylist relationship. Standing up for long periods of time while working, however, can have drawbacks.

A person who stands up during an entire work day can become tired and experience fatigue. This can affect a worker's ability to perform hairstyling services and his ability to follow his client's directions and properly interact with the client. Further, a person who stands for protracted periods of time can experience health effects such as swollen legs, swollen ankles, back pain and painful lower extremities. As a result, many hairstylists must often take breaks during a work day and either sit in chairs or lie down. This reduces their ability to produce and therefore negatively impacts revenue. If the negative health effects of standing up for long periods go untreated, a worker can become injured and lose his ability to work for a certain period of time, or worse, permanently.

One approach to this problem is the use of conventional chairs. At times, a hairstylist will sit on a chair or stool while attempting to perform his hairstyling duties. There are, however, problems associated with this solution. A worker that is sitting down cannot move around his client as he cuts or styles the client's hair. Also, while sitting down, the worker does not have the freedom of movement to pick up and put down instruments and wield his instruments for use on the client. Lastly, the sitting position does not allow the worker to interact with the client at eye level. Therefore, the use of a conventional chair while performing hairstyling services is limiting to the worker and thus is not often used.

Consequently, a need exists to overcome the problems with the prior art as discussed above, and particularly for a more efficient way to facilitate the process of providing structural support to hairstylists while they are providing hairstyling services.

SUMMARY OF THE INVENTION

Briefly, according to an embodiment of the present invention, a chair apparatus for facilitating performance of hairstyling services is disclosed. The chair apparatus includes a seat and a shaft coupled to a bottom face of the seat. The chair apparatus further includes a base coupled to a bottom end of the shaft and one or more castors coupled to a bottom face of the base. The chair apparatus further includes an arm coupled to the shaft, wherein the arm extends from the shaft to substantially the height of the seat. The chair apparatus further includes a tray coupled to a top end of the arm, wherein the tray comprises a flat surface and one or more hooks.

According to a second embodiment of the present invention, a chair apparatus for facilitating performance of hairstyling services is disclosed. The chair apparatus includes a seat comprising a saddle shape and a telescopic shaft coupled to a bottom face of the seat. The chair apparatus further includes a base coupled to a bottom end of the shaft and one or more castors coupled to a bottom face of the base. The chair apparatus further includes an arm coupled to the shaft, wherein the arm extends from the shaft to substantially the height of the seat. The chair apparatus further includes a tray coupled to a top end of the arm, wherein the tray comprises a flat surface and one or more hooks The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings.

DETAILED DESCRIPTION

The present invention provides a chair apparatus for facilitating the performance of hairstyling services. The apparatus of the present invention is beneficial to a professional in the hair and beauty industry as it provides relief from having to stand for protracted periods of time while working. The present invention allows a hairstylist to have the option of sitting when needed, thereby allowing him to rest his legs and back while working. This can lead a hairstylist to work longer and increase production. The present invention may also provide an easy to reach lever for adjusting the height of the saddle to a professional's liking, such as the normal height of the professional while standing, therefore allowing for seamless sitting and taking weight off one's feet. The present invention further provides an easily accessible tray with hooks, on which instruments can be placed. Being within easy reach, the worker is not required to reach over his client or waste time walking over to untangle or access his instrument. The tray may also include electrical outlets which allow the professional's instruments to be electrically connected and/or recharged via the chair apparatus.

Figure 1:
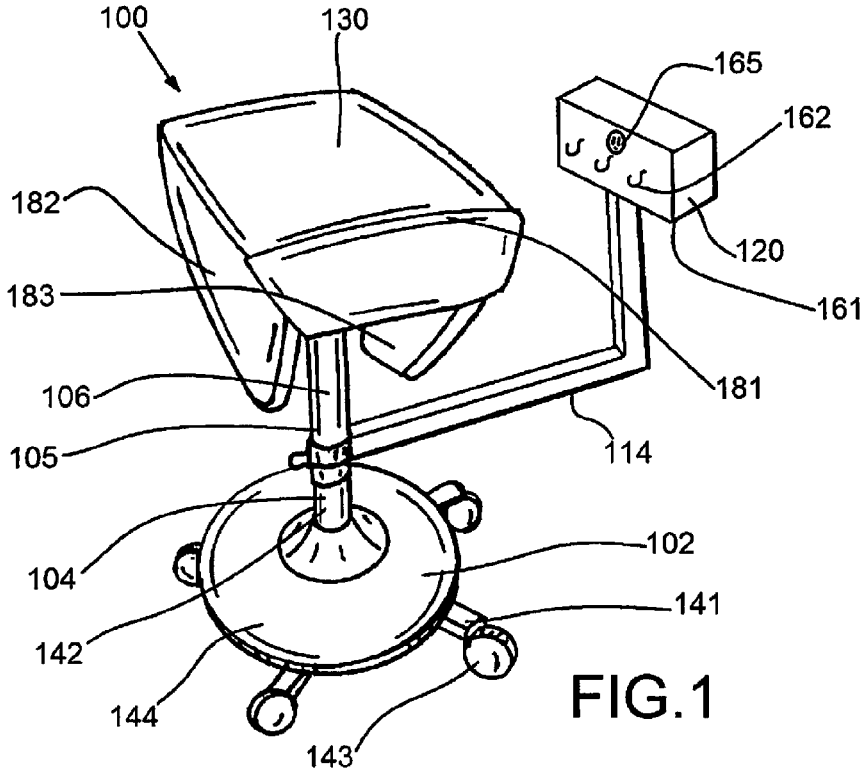
FIG. 1 is an illustration of a perspective view of a chair apparatus according to one embodiment of the present invention.
Figure 3:
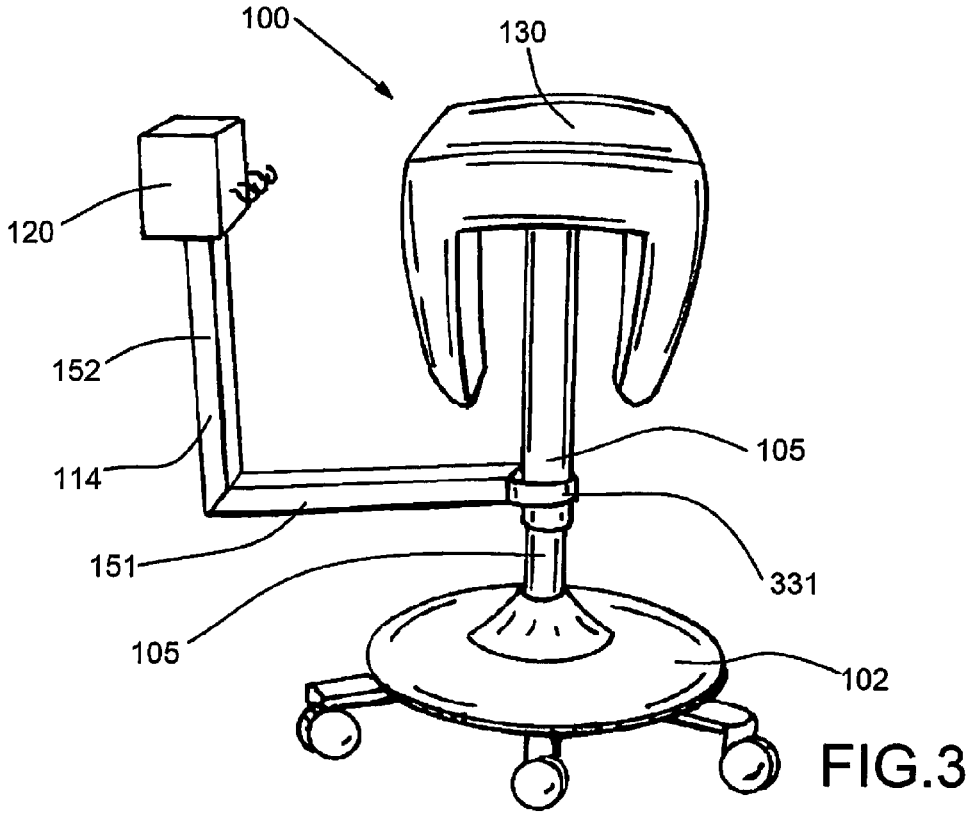
FIG. 3 is a frontal view of the apparatus of FIG. 1.
Figure 2:
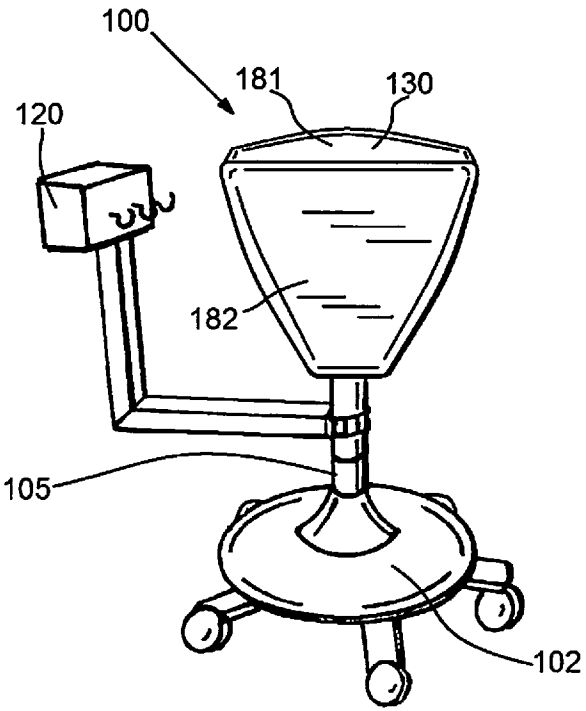
FIG. 2 is a side view of the apparatus of FIG. 1.
Figure 4:
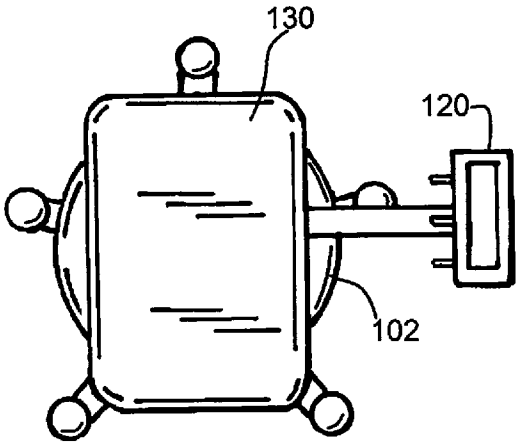
FIG. 4 is a top view of the apparatus of FIG. 1.

The present invention will now be described with reference to FIGS. 1 through 4. FIG. 1 is an illustration of a perspective view of a chair apparatus 100 according to one embodiment of the present invention. FIG. 1 shows a chair apparatus 100 for facilitating the performance of hairstyling services. The apparatus 100 includes a seat 130 comprising an element substantially shaped like a saddle. A substantially saddle shape comprises a top surface upon which the user's buttocks rest, and side surfaces on either side that extend downwards from the top surface in the location where the user's legs would be positioned. The saddle shape may also include a concave or curved surface that accommodates the natural curves of a user's buttocks, underside and legs so that the user may more comfortably rest on the seat 130. The shape of the scat 130 allows the worker to grip the seat 130 with his legs and allow for freedom of movement of his torso and his upper body. The worker may stabilize his lower body by gripping the seat 130 with his legs while his upper body is engaged in hairstyling activities.

The seat 130 may comprise a rigid interior, comprised of wood, plastic or metal, covered by a soft exterior. The soft exterior of the seat 130 may comprise a cushion covered by a fabric or leather. In one embodiment of the present invention, a frontal (see FIG. 3) or rear view of the seat 130 shows a substantially upside down U-shaped cross section to the seat 130. In this embodiment, the seat 130 comprises a top flat surface 181 positioned horizontally and two flat side surfaces 182, 183 that extend downwards from the sides of surface 181 at roughly ninety-degree angles from surface 181. The two flat side surfaces 182, 183 may be substantially triangular in shape. This shape allows the worker's legs to grip the seat 130 in the following way: the worker's legs bend at the hip and the knee while sitting on the seat 130; the worker's upper legs (e.g., femurs) extend from the top surface 181 to the sides of the two flat side surfaces 182, 183; the worker's knees extend past the sides of the two flat side surfaces 182, 183; and the worker's lower legs (e.g., tibias) extend over the two flat side surfaces 182, 183 so that his feet are located approximately at the bottom of the two flat side surfaces 182, 183, such that the worker may grip the seat 130 between his upper legs, his knees, his lower legs and his feet.

In one embodiment of the present invention, the apparatus 100 includes a seat back, which comprises a vertically positioned planar element that sits behind and to the side of the seat 130 so as to provide support for the user's back while sitting on the apparatus 100. The seat back may be coupled to the shaft 105 and may be adjustable so as to adjust its height and distance from the seat 130.

The apparatus 100 also includes a shaft 105 positioned vertically and connected to an underside of the scat 130. The shaft 105 may be a telescopic shaft that comprises a first tubular element 106 coupled to a bottom face of the seat 130 and a hollow cylindrical element 104, wherein the tubular element 106 fits securely within the hollow cylindrical element 104. The tubular element 106 may move up and down within the hollow cylindrical element 104 so as to adjust the height of the seat 130. The telescopic effect of the shaft 105 may be realized using any one of electrical means, such as an electric motor, hydraulics means and pneumatic means that are activated using a lever or a control panel.

In a preferred embodiment of the present invention, a hydraulic element, such as an air or oil-infused piston, may be situated under or within element 106 so as to allow the element 106 to move upwards or downwards. The activation of the piston is dependent on the activation of the lever or a control panel. The lever may activate the piston situated under or within element 106 by affecting the ingress of egress of air or oil within a chamber of the piston.

The apparatus 100 further includes a base 102 coupled to a bottom end of the hollow cylindrical element 104. The base 102 may include one or more legs 141 that extend perpendicularly from the bottom end of element 104, as in the common arrangement seen in conventional office chairs. That is, the base comprises three or more elongated elements 141 that extend horizontally from a center point 142. One or more castors 143 may be coupled to a bottom face of the base 102, so as to allow the apparatus 100 to be moved about on wheels. In one embodiment of the present invention, a castor 143 is coupled to the end of each elongated elements 141. In another embodiment of the present invention, the top of the base 102 is covered by a planar element 144 that provides a footing for the user's feet such that the user may rest his feet on the planar element.

The apparatus 100 also includes an arm 114 coupled to the shaft 105 or the hollow cylindrical element 104 via a circular element 331 that grasps the shaft 105 or element 104. The arm 114 extends from the hollow cylindrical element 104 to substantially the height of the seat 130. The arm 114 may comprise a horizontal portion 151 that extends horizontally from the shaft 105 and a vertical portion 152 that extends vertically from an end of the horizontal portion 151 to substantially the height of the seat 130. Alternatively, the arm 114 may comprise a curved element that extends horizontally from the shaft 105 and subsequently vertically to substantially the height of the seat 130.

FIG. 1 also shows a tray 120 coupled to a top end of the arm 114, wherein the tray 120 comprises a flat surface 161 and one or more hooks 162, on which instruments, such as hair clippers, scissors and hair dryers, may be placed. The tray 120 may include a box-like shape that allow for items such as instruments to be placed within the box. Further, the tray 120 may include one or more conventional electrical outlets 165 for providing current for powering one or more hairstyling instruments, such as hair clippers or blow dryers. The electrical wiring for the outlets may originate at a conventional electrical outlet at the base 102, continue with wiring that travels from the electrical outlet at the base 102 through the shaft 105, through the arm 114 and up to the tray 120, wherein the electrical wiring terminates at another conventional electrical outlet wherein electrical hairstyling instruments may be plugged in. The conventional electrical outlet located at the base 102 (or, alternatively, shaft 105) may be coupled to a conventional electrical wall outlet via conventional electrical wiring with conventional plugs at both ends.

In one embodiment of the present invention the apparatus 100 may also include one or more foot rests 110 coupled to the hollow cylindrical element 104, wherein the one or more foot rests 110 are hingably attached to hollow cylindrical element 104 so as to be retractable from a horizontal position to a vertical position.

The various components of apparatus 100 may be manufactured from a variety of materials including metal, such as stainless steel, titanium, aluminum or any metal alloy, rigid fabric, carbon fiber, epoxy resin, graphite, rubber, plastic or any combination of the above.

Plastic covers a range of synthetic or semi-synthetic polymerization products. Plastics are composed of organic condensation or addition polymers and may contain other substances to improve performance or economics. In the present invention, plastic may comprise any one of the following forms of plastic: polyethylene, polystyrene, high impact polystyrene, polyethylene terephthalate, nylon, polypropylene, acrylonitrile butadiene styrene (ABS), bayblend and polyvinylidene chloride (PVC).

The various components of apparatus 100 may be manufactured of the present invention can be manufactured from a plastic compound using any variety of processes, such as injection molding, fusible core injection molding and thermoforming.

Injection molding is a manufacturing technique for making parts from thermoplastic material in production. Molten plastic is injected at high pressure into a mold, which is the inverse of the product's shape. After a product is designed by an industrial designer, molds are made by a mold-maker from metal, usually either steel or aluminum, and precision-machined to form the features of the desired part. Injection molding is widely used for manufacturing a variety of parts and is the most common method of plastic production.

The most commonly used thermoplastic materials are polystyrene, ABS or acrylonitrile butadiene styrene, nylon, polypropylene; polyethylene, and polyvinyl chloride or PVC.

Injection molding machines, also known as presses, hold the molds in which the components are shaped. Presses are rated by tonnage, which expresses the amount of clamping force that the machine can generate. This pressure keeps the mold closed during the injection process.

Molds separate into at least two halves (called the core and the cavity) to permit the plastic part to be extracted. In general, the shape of a part must not cause it to be locked into the mold. For example, sides of objects typically cannot be parallel with the direction of draw (the direction in which the core and cavity separate from each other). They are angled slightly. Pins are the most popular method of removal from the core, but air ejection, and stripper plates can also be used depending on the application. Most ejection plates are found on the moving half of the tool, but they can be placed on the fixed half.

Molds are built through two main methods: standard machining and EDM machining. Standard machining, in its conventional form, has historically been the method of building injection molds. With technological development, computer numerical control (CNC) machining became the predominant means of making more complex molds with more accurate mold details in less time than traditional methods.

The electrical discharge machining (EDM) or spark erosion process has become widely used in mold making. EDM is a simple process in which a shaped electrode, usually made of copper or graphite, is very slowly lowered onto the mold surface (over a period of many hours), which is immersed in paraffin oil. A voltage applied between tool and mold causes erosion of the mold surface in the inverse shape of the electrode.

Fusible core injection molding or lost core injection molding is a specialized plastic injection molding process. It is used in the manufacture of molded components with cavities or undercuts, which would not be possible with tools having dc-moldable cores. The process consists of three essential steps. First, a core consisting of a low melting point metal is poured in the shape of the cavity specified for the molded component. This is inserted into the injection mold in the second step and injected with plastic. Molded component and core are both de-molded and, in the third step, immersed in a heated bath to melt out the core. The bath temperature is selected to be somewhat higher than that of the core alloy's melting point, but not so that the injected part would be damaged. Induction heating of the core metal in the heated bath reduces the melt out time to a few minutes. Liquid core metal collects on the bottom of the heated bath and is usable for a new core.

Thermoforming is a manufacturing process for thermoplastic sheet or film. The sheet or film is heated between infrared, natural gas, or other heaters to its forming temperature. Then it is stretched over or into a temperature-controlled, single-surface mold. Cast or machined aluminum is the most common mold material, although epoxy and wood tooling are sometime used for low volume production. The sheet is held against the mold surface unit until cooled. The formed part is then trimmed from the sheet. The trimmed material is usually reground, mixed with virgin plastic, and reprocessed into a usable sheet. There are several categories of thermoforming, including vacuum forming, pressure forming, twin-sheet forming, drape forming, free blowing, and simple sheet bending.

In one embodiment of the present invention, the components of tray 120 and arm 114 may be manufactured from a material that dissipates or insulates the heat created by blow-dryers during use. The material used to manufacture the components of tray 120 and arm 114 may possess heat isolative properties that prevent the outside surface of the tray 120 and arm 114 from overheating. Alternatively, the material used to manufacture the components of tray 120 and arm 114, such as metal, may possess heat conductive properties that quickly dissipate the heat originating from blow-dryers. Alternatively, the material used to manufacture the components of tray 120 and arm 114 may possess any combination of heat insulating and heat conducting properties so as to accomplish the goal of re-directing the heat emanating from the use of blow-dryers. Such redirection of heat is beneficial as it reduces or eliminates the negative implications of high temperatures, including overheating or burning of the apparatus 100 or instruments placed on or in it.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

The invention claimed is:

1. A chair apparatus for facilitating performance of hairstyling services, comprising:

A) a straddle seat, comprising an entirely convex top surface;

B) a shaft coupled to a bottom face of the seat;

C) a base coupled to a bottom end of the shaft;

D) one or more castors coupled to a bottom face of the base;

E) an arm coupled to the shaft, wherein the arm extends from the shaft to substantially a height of the seat;

F) a tray coupled to a top end of the arm, wherein the tray comprises a flat surface and one or more hooks, said tray comprises one or more electrical outlets for providing current for powering one or more hairstyling instruments; and G) two flat elongated symmetrical side surfaces extending downwardly from the top surface wherein the seat comprises an upside down U-shape.

2. The chair apparatus of claim 1, wherein the shaft comprises a tubular element that fits securely within a hollow cylindrical element, wherein the tubular element is coupled at a top end to a bottom facing side of the seat and wherein tubular element slides within the hollow cylindrical element so as to adjust the height of the seat.

3. The chair apparatus of claim 2, wherein the base comprises three or more elongated elements that extend horizontally from a center point.

4. The chair apparatus of claim 3, wherein each said one or more castors is coupled to a respective end of each of the three or more elongated elements.

5. The chair apparatus of claim 4, wherein the arm comprises a horizontal portion that extends horizontally from the shaft and a vertical portion that extends vertically from an end of the horizontal portion to substantially a height of the seat.

6. The chair apparatus of claim 4, wherein the arm comprises a curved element that extends horizontally from the shaft and subsequently vertically to substantially a height of the seat.

7. The chair apparatus of claim 5, wherein the tray comprises a box-shaped element having a plurality of hooks that extends from the box-shaped element.

8. A chair apparatus for facilitating performance of hairstyling services, comprising:

A) a straddle seat having an entirely convex top surface and two flat elongated symmetrical side surfaces extending downwardly from the top surface wherein the seat comprises an upside down U-shape;

B) a telescopic shaft coupled to a bottom face of the seat, wherein the telescopic shaft comprises a tubular element that fits securely within a hollow cylindrical element, wherein the tubular element is coupled at a top end to a bottom facing side of the seat and wherein tubular element slides within the hollow cylindrical element so as to adjust the height of the seat;

C) a base coupled to a bottom end of the shaft;

D) one or more castors coupled to a bottom face of the base;

E) an arm coupled to the shaft, wherein the arm extends from the shaft to substantially a height of the seat; and F) a tray coupled to a top end of the arm, wherein the tray comprises a flat surface and one or more hooks, said tray comprises one or more electrical outlets for providing current for powering one or more hairstyling instruments.

9. The chair apparatus of claim 8, wherein the base comprises three or more elongated elements that extend horizontally from a center point.

10. The chair apparatus of claim 9, wherein each said one or more castors is coupled to a respective end of each of the three or more elongated elements.

11. The chair apparatus of claim 10, wherein the tray comprises a box-shaped element having a plurality of hooks that extends from the box-shaped element.

* * * * *